US007712491B2

(12) United States Patent
Tochon-Danguy et al.

(10) Patent No.: US 7,712,491 B2
(45) Date of Patent: May 11, 2010

(54) PROCESS AND DEVICE FOR THE DOSE DISPENSING OF A RADIOACTIVE SOLUTION

(76) Inventors: Henri-Jaques Tochon-Danguy, 17 Thompson Drive, Rosanna, Victoria 3084 (AU); Stanislav Samuel Poniger, 428 Waverley Road, Mount Waverley, Victoria 3149 (AU)

( * ) Notice: Subject to any disclaimer, the term of this patent is extended or adjusted under 35 U.S.C. 154(b) by 596 days.

(21) Appl. No.: 10/562,766

(22) PCT Filed: Jul. 2, 2004

(86) PCT No.: PCT/AU2004/000897

§ 371 (c)(1),
(2), (4) Date: Dec. 27, 2005

(87) PCT Pub. No.: WO2005/002971

PCT Pub. Date: Jan. 13, 2005

(65) Prior Publication Data

US 2006/0151048 A1 Jul. 13, 2006

(30) Foreign Application Priority Data

Jul. 2, 2003 (AU) ..... 2003903404

(51) Int. Cl.
*B65B 1/04* (2006.01)

(52) U.S. Cl. ..... 141/97; 141/26; 141/105; 600/5

(58) Field of Classification Search ..... 141/97, 141/25, 26, 27, 100, 102, 104, 105; 600/5
See application file for complete search history.

(56) References Cited

U.S. PATENT DOCUMENTS

| | | | | |
|---|---|---|---|---|
| 3,935,883 | A * | 2/1976 | Stach et al. | 141/27 |
| 4,041,994 | A | 8/1977 | Horwitz et al. | |
| 4,662,231 | A | 5/1987 | Schaarschmidt et al. | |
| 4,853,546 | A * | 8/1989 | Abe et al. | 250/432 PD |
| 5,039,863 | A * | 8/1991 | Matsuno et al. | 250/432 PD |
| 5,911,252 | A | 6/1999 | Cassel | |
| 7,117,901 | B2 * | 10/2006 | Gisper-Sauch et al. | 141/2 |

FOREIGN PATENT DOCUMENTS

GB 1415804 11/1975

* cited by examiner

*Primary Examiner*—Gregory L Huson
*Assistant Examiner*—Jason K Niesz
(74) *Attorney, Agent, or Firm*—Edwin D. Schindler

(57) ABSTRACT

An apparatus and method for automatically dispensing a radioactive dose by filling a container, such as a vial or disposable syringe, with a required radioactive dose in a sterile environment; the apparatus being stand alone and radioactive-shielded. The apparatus further includes a control device for accurately dispensing and diluting the required radioactive dose using an online radioactivity measurement, which does not require knowledge of the volumetric radioactivity of the stock solution.

9 Claims, 3 Drawing Sheets

PROCESS AND DEVICE FOR THE DOSE DISPENSING OF A RADIOACTIVE SOLUTION

AREA OF THE INVENTION

This invention relates to apparatus used in nuclear medicine and in particular to a means whereby a radioactive dose required can be provided to a syringe in an automated fashion which obviates the need for a person to actually handle the radioactive material.

BACKGROUND OF THE INVENTION

Radioactive solutions called radiotracers or radiopharmaceuticals, have found applications in various medical fields, in particular in medical diagnostic and therapeutic fields. In recent years the advance of Positron Emission Tomography (PET), which use radionuclides (radioisotopes) of significant higher radiation energy than more conventional nuclear medicine isotopes, has raised some concerns about hand and body radiation exposure received by the persons preparing the dose.

The dangers of ionising radiation are well known and apply to all persons being exposed to radiation, including the staff involved in the preparation of radioactive solutions. Dose fractionation of the radioactive solutions is usually a manual process, performed behind a lead shielded screen to minimal exposure to radiation. However, the performance of this task is time consuming, as the operator needs to withdraw by successive iterations, small volumes of the radiotracer, until he reaches the targeted dose.

After each withdrawal the needle needs to be re-capped and the syringe placed in a dose calibrator to determine if more or less of the radioactive solution should be processed in or out of the syringe. When the targeted dose has been achieved (within ±10%), the syringe may be topped up with saline to obtain a reasonable volume.

Before being released or dispatched for clinical use, the syringe is placed again in the dose calibrator to print out the accurate dose record. To date, very little attempt has been made by manufacturers to design automated equipment capable of withdrawing a dedicated radioactive dose into a disposable sterile syringe or vial.

The very few systems currently on the market are expensive and bulky and are not widely available. Other more affordable systems are either not technically practical or do not achieve efficient radiation protection and need to be operated in a shielded environment. In addition, most of these apparatus rely on the pre-requisite knowledge of the volumetric radioactivity (Ci/mL or Bq/mL) of the stock solution to determine the corresponding volume and hence the radioactive dose to be dispensed.

OUTLINE OF THE INVENTION

It is an object of this invention to provide an accurate means of automatically dispensing individual doses of a radioactive solution into vials or syringes under aseptically controlled conditions while minimising the exposure to radiation of an operator which would otherwise be associated with the manipulation of radioactive solutions.

The invention in one aspect is a radioactive dose dispensing device for automatically filling a container with a required radioactive dose in a sterile environment, said device being stand alone and radiation shielded and including control means to control a mix of radioactive stock solution and dilution stock solution, the radioactivity of which mix is monitored by radiation detection means.

The invention in a second aspect is a method of automatically dispensing a dose of a radioactive solution using a software controlled lead shielded device which includes the steps of

- providing the device with a radioactive stock solution and a dilution stock solution
- using a computer software interface to the device to control the dose dispensed automatically into a syringe or vial in the device.

It is preferred that the radioactive dose dispensing device be used for filling a disposable syringe. It is further preferred that a shielded receptacle be provided to receive the syringe.

It is also preferred that a fork shaped arm be provided to actuate the plunger of the disposable shielded syringe. It is further preferred that a high precision linear drive mechanism to move either the syringe or its plunger in a vertical direction.

It is preferred that a customised disposable T shaped tubing assembly be used to provide a sterile fluid pathway. It is further preferred that pinch valves be provided to switch between the radioactive stock solution and the dilution stock solution.

It is also preferred that the automation of the device be controlled by a programmable logic controller (PLC) in association with a radiation detector which monitors on-line the radioactive dose passing through the tubing and being dispensed into the syringe.

It is further preferred that the PLC controls the automation tasks and relevant mathematical calculations for dispensing a requisite dose and that this be operable by computer means with an associated printer although any desired arrangement could be used.

In order that the invention may be more readily understood an embodiment of it will be described herein by way of non limiting example with reference to the accompanying drawings

BRIEF DESCRIPTION OF THE DRAWING FIGURES

BRIEF DESCRIPTION OF AN EMBODIMENT OF THE INVENTION

Figure 1:
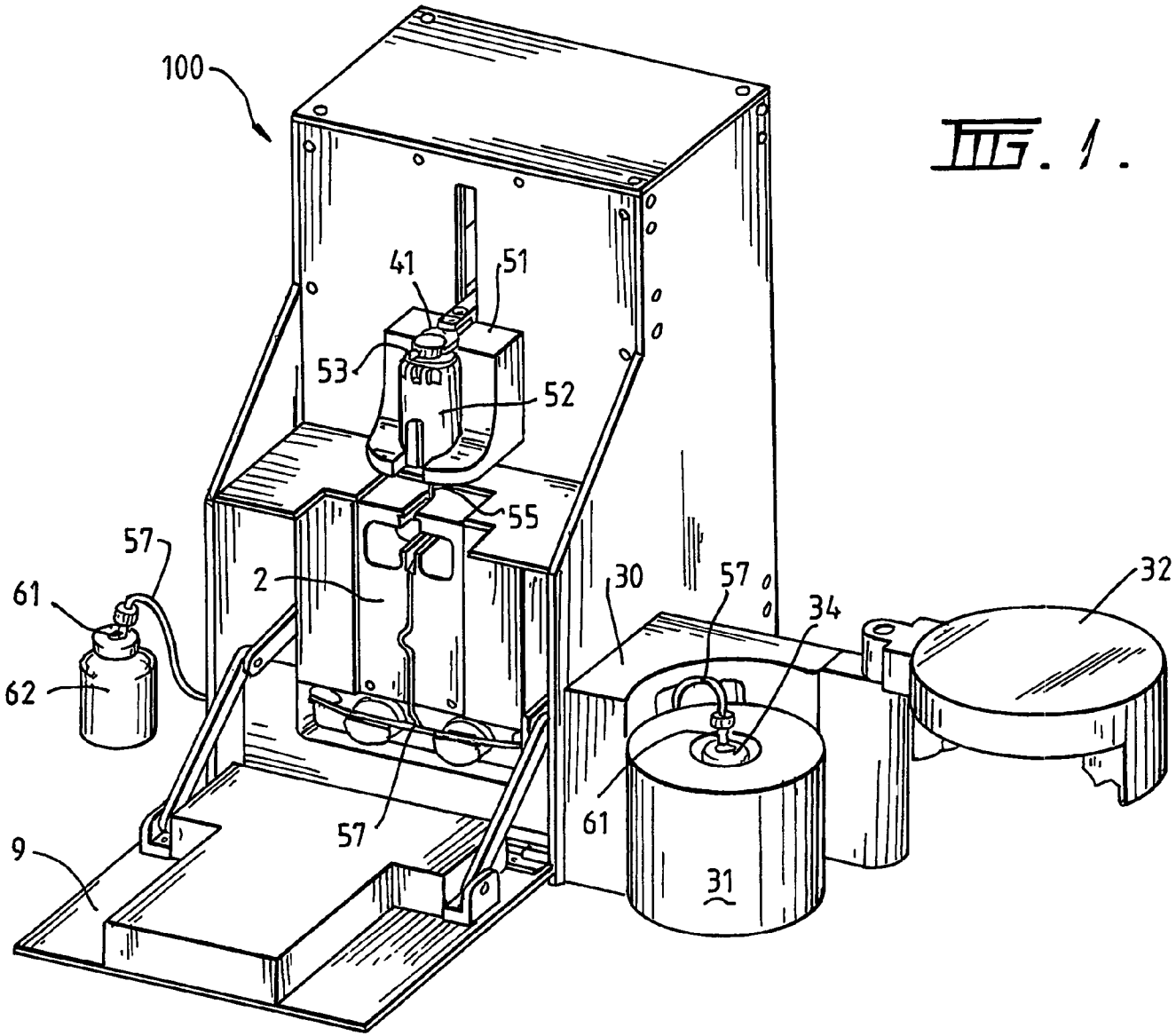
FIG. 1 Shows a perspective view of the components of the radioactive dose dispensing device of the invention in its "open" orientation.
Figure 2:
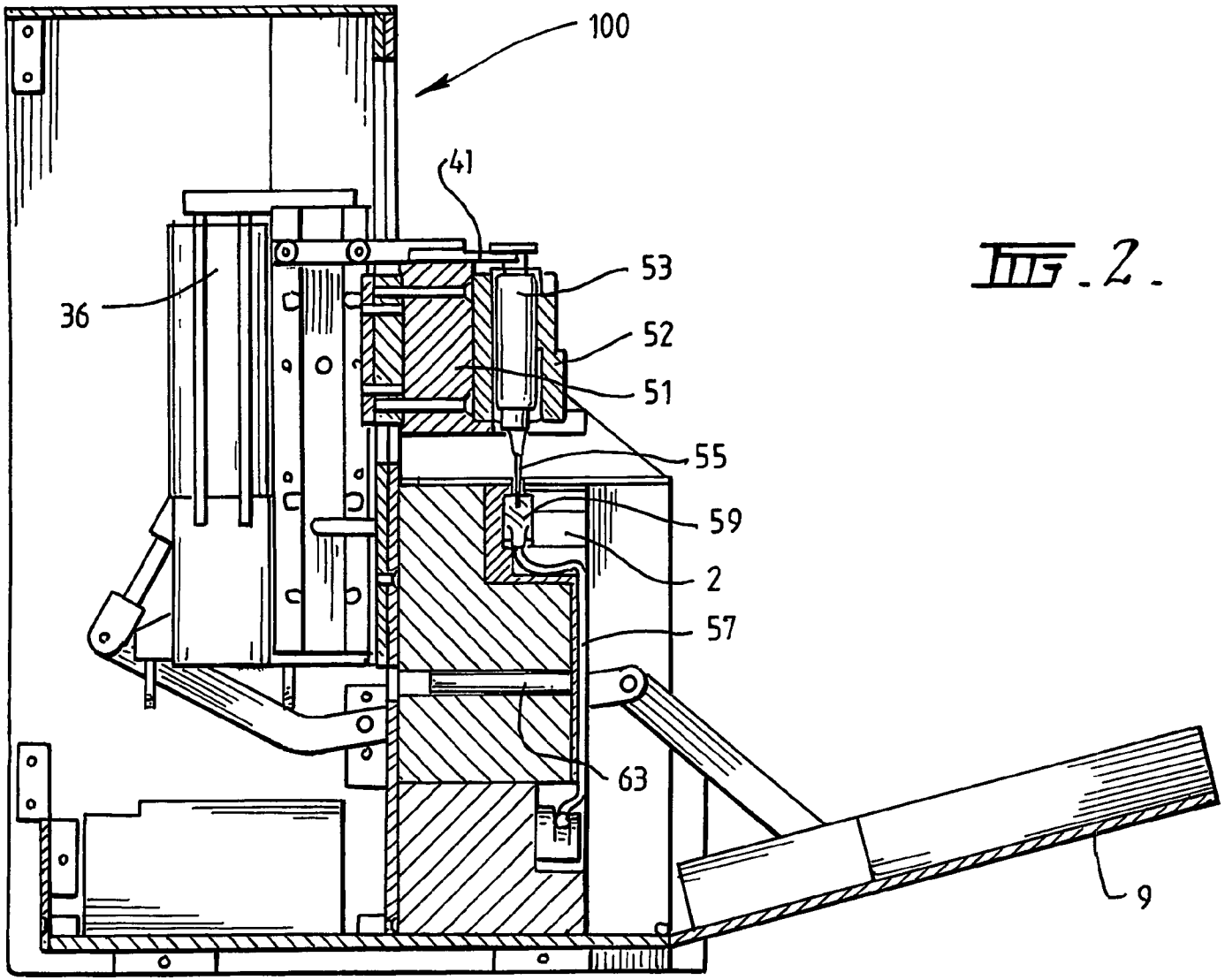
FIG. 2 Shows a cross-section though the device of the invention as shown in FIG. 1.

The invention 100 in one embodiment is a device for the automatic filling of disposable syringes with a radioactive solution (radiopharmaceutical) for injection or infusion into a patient.

The device 100 is a stand alone equipment that does not require any additional lead shielding and can be directly used on a bench or inside a conventional, unshielded, laminar flow cabinet.

The device includes a concave lead block 30 and a swinging lead lid 32 designed to accommodate standard lead shielded pots 31 commonly used for the transport of radioactive solutions. It also includes a receptacle 51 that can accommodate various shapes of commercially available tungsten syringe shields and provides an easy and safe installation of the syringe shield 52.

The device further includes a fork-shape arm 41 that can hold or release the plunger of the syringe and an electro-actuator that can link the linear drive 36 to the receptacle 51, and drive up/down the syringe and its needle 55 to pierce the Luer Slip Injection Site 59.

The device provides a permanent link between the linear drive 36 and the fork-shape arm 41 and allows both the radioactive solution and the diluting solution to be drawn at a constant fluid flow rate through the tubing and into the syringe.

Figure 3:
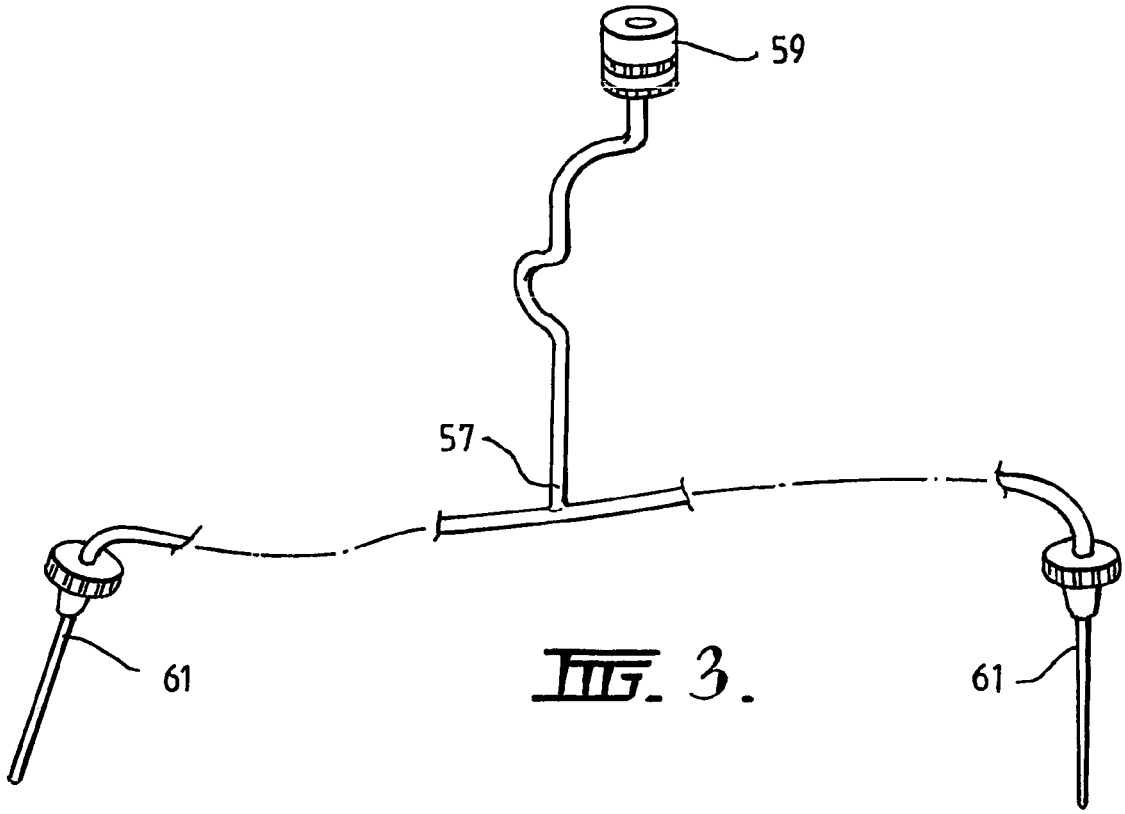
FIG. 3 Shows the pre assembled sterile disposable tubing kit used in the device.
Figure 4:
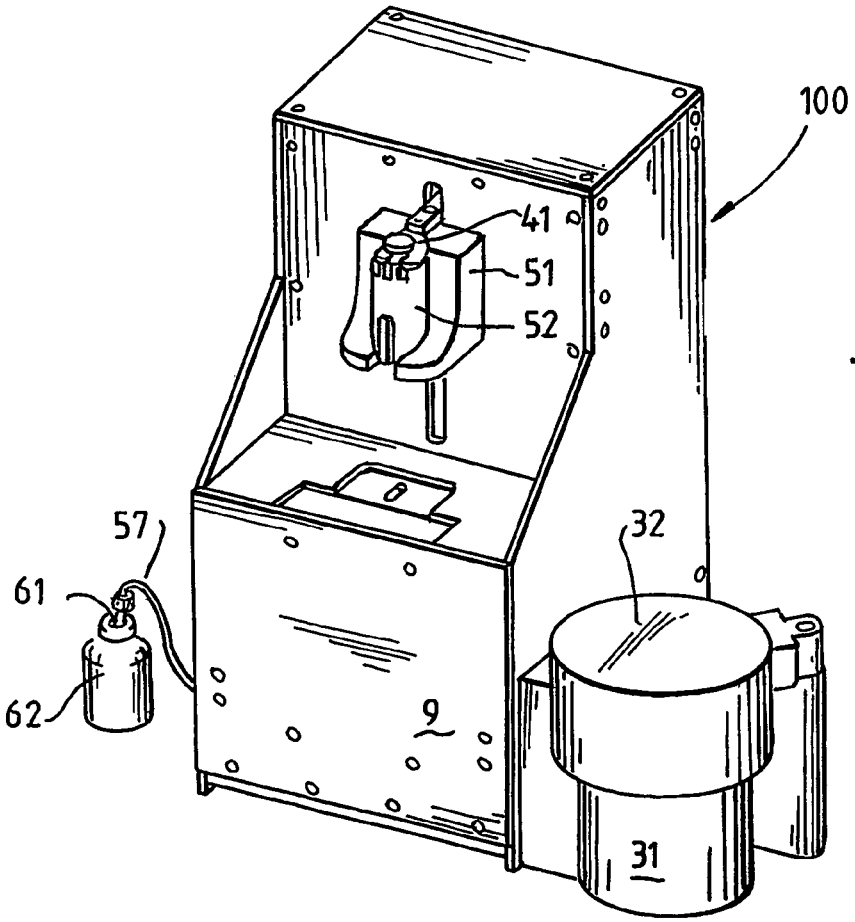
FIG. 4 Shows the device of the invention in its "closed" orientation.

The Luer Slip Injection Site 59 is attached to the upper tubing assembly and two Luer-lock fittings 61 (with needles) are attached to the lower tubes assembly (see FIG. 3 for view of the pre-assembled sterile disposable kit).

The tubing assembly is held in its appropriate position by a small groove and a dedicated shaped recess 2 to accurately position the Luer Slip Injection Site 59, in regard to the needle 55.

The device is provided with both radioactive and diluting stock solutions which are dispensed from their respective vials 34 and 62, up to the syringe by passing through a disposable, sterile and non-pyrogenic fluid pathway with the radioactive amount controlled by a radiation detector 63, which in this embodiment of the invention is a Geiger-Muller tube or PIN photodiode and located behind a portion of the tube assembly leading to the injection site (behind the plate holder 2).

The device is automated via a programmable PLC and is connected to a computer serving as a user interface, and preferably is provided with a printer to print the syringe or vial label showing the activity, date, time, batch, patient name, etc. or whatever may be required.

The dispensing of the radioactive dose is done on-line by measuring the true amount of radioactivity passing in front of the radiation detector 63 and the total volume required into the syringe is automatically adjusted by dilution.

The device also includes a safety cross-evaluation of the delivered radioactive dose which is automatically performed using the traditional volumetric dispensing method, and the volumetric method can also be used as the main dispensing method.

It is further envisaged that the device of the invention may include a built-in sterile air flow, designed to allow the device to be operated on a bench in a conventional room but still maintaining full compliance with a 3.5 class (A class) dispensing environment, characterized by a sterile air flow directed towards the Luer Slip Injection Site 59 and needle 55.

It is also envisaged that in another embodiment of the invention a sterile disposable double check-valve could be located between the syringe 53 and needle 55, or underneath the Luer Slip Injection Site 59 to allow the transfer of an accurate dose of radioactive solution through a tube, to externally located vials or containers.

Operation of the Device

When the device is being operated the user opens the door 9 of the device and installs a new tubing kit 57 onto the tubing holder 2. The Luer Slip Injection Site 59 attached to the upper T-shape tube is slid into the appropriate recess and both needles 61 attached to the lower T-shape tubes are fed through each lead channel and connected to the radioactive stock solution 34 and the dilution stock solution 62.

The user then rotates the lid 32 and closes the door 9 and introduces a disposable syringe 53 with its appropriate needle 55 into a tungsten syringe shield 52. At this point the needle is un-capped and the tungsten syringe shield is placed onto the receptacle 51 on the front face of the device. The operator then enters on the computer the requested radioactive dose and total volume.

The device lowers the receptacle 51 enabling the syringe to pierce the Luer Slip Injection Site with the needle. The filling sequence will automatically dispense the desired radioactive dose into the syringe and dilute it to match the requested volume by actuation of the syringe plunger. Once the syringe has been filled (less than one minute), the syringe and syringe shield are lifted away from the Luer Slip Injection Site, and the syringe and syringe shield is removed from the device and needle re-capped. At the end of the process, a syringe label is printed with the appropriate dose data.

SUMMARY OF THE EMBODIMENT OF INVENTION

Traditionally the accurate knowledge of the volumetric radioactivity (specific activity: Ci/mL or Bq/mL) of a radioactive stock solution is required for the accurate dispensing of any radioactive dose.

For example, a dose of 3 mCi (111 MBq) of a radioactive solution with a volumetric radioactivity of 50 mCi/mL (1850 MBq/mL) will be precisely achieved by dispensing a volume of 0.06 mL. However, volumetric radioactivity of solutions is not always determined with great accuracy at the time of the manufacturing of the product, and post measurement of the volumetric radioactivity at the customer site is regarded as a critical operation.

The invention has the novel feature in that it can accurately dispense a requested radioactive dose without any knowledge of the volumetric radioactivity of the stock solution by an on-line radioactivity measurement and without exposing an operator to the radiation.

In the invention, a radiation detector 63 being a Geiger-Muller tube, a PIN photodiode or other fast measuring device is located behind a portion of the tubing leading to the injection site 59 and then to the syringe 53. The radiation detector continuously monitors the radioactive dose passing through the tube and into the syringe at a very constant liquid flow rate and the PLC 11 determines the appropriate switching sequence of the valves to dispense the requested dose and volume.

The program also calculates online the corresponding radioactivity contained in the dead volume of the tubing which will be inevitably added-on during the dilution phase of the syringe filling. That corresponding radioactivity is subtracted from the required dose by the PLC 11 to identify the amount of radioactivity allowed to pass the radiation detector 63. At the end of the filling process, the sum of the amount of activity allowed to pass by the detector before the dilution phase and the resultant activity gained during the dilution phase due to the dead volume of the tubing kit, translates to the required dose.

Below is the formula used to determine how much of the stock solution needs to be drawn-up into the syringe to achieve the desired dose (this calculation is performed continuously during the filling process):

Let RD=Requested dose

ADV=Activity contained in the dead volume of the tubing

RMT=Radioactivity measured passing through the tubing

VA=Volumetric activity of the stock solution

DV=Dead volume of the tubing

SA=Volumetric radioactivity

VSW=Volume of stock solution withdrawn from vial

Therefore the radioactive amount of stock solution to draw-up into syringe:

$$= RD - ADV$$

$$= RD - (DV \times SA)$$

$$= RD - (DV \times (RMT / (VSW - DV))$$

Using the above method of filling a syringe with a radioactive solution, it is not necessary to know the specific activity of the stock solution prior to the filling process, as it is calculated during the filling process.

The accuracy of the dose dispensed is a function of the volumetric radioactivity of the radioactive stock solution, and experiments have shown accuracy better than 5% for volumetric radioactivity in the range of 0-50 mCi/mL (0-1850 MBq/mL) and better than 10% for volumetric radioactivity in the range of 50-100 mCi/mL (0-3700 MBq/mL).

The invention lies in an automated means of preparing a dose of a radiopharmaceutical into a disposable syringe under computer control by means of a radiation detector to determine the radioactive dosage and dilution by a non radioactive solution to achieve a desired volume. By this means such a dose can be prepared without unnecessary radiation exposure occurring to the person preparing the dose.

The precise components of the apparatus of the invention may be varied provided they achieve the method of the invention as described. It is further envisaged that other embodiments of the invention will exhibit any number of and any combination of the features of those previously described and whilst we have described herein one specific embodiment of the invention it is to be understood that variations and modifications in this can be made without departing from the spirit and scope thereof.

The claims defining the invention are as follows:

1. A radioactive dose dispensing apparatus for automatically filling a container with a required radioactive dose in a sterile environment, comprising:

a container for containing a radioactive dose;

means for radiation shielding of said radioactive dose dispensing apparatus;

means for controlling a mix of radioactive stock solution and dilution stock solution for automatically diluting the radioactive stock solution with the dilution stock solution as both the radioactive stock solution and the dilution stock solution simultaneously pass into said container;

means for detecting radioactivity of said mix of radioactive stock solution and dilution stock solution; and, means for automating said radioactive dose dispensing apparatus and calculating a required dose for controlling the radioactive dose being dispensed into said container, said means for automating said radioactive dose dispensing apparatus and calculating a required dose comprising a programmable logic controller operable in combination with a radiation detector.

2. The radioactive dose dispensing apparatus according to claim 1, wherein said container is disposable.

3. The radioactive dose dispensing apparatus according to claim 1, further comprising a shielded receptacle for receiving said container.

4. The radioactive dose dispensing apparatus according to claim 1, wherein programmable logic controller is operable via a computer interface.

5. The radioactive dose dispensing apparatus according claim 1, further comprising a disposable tubing assembly for providing a sterile fluid pathway for the dilution stock solution.

6. The radioactive dose dispensing apparatus according claim 1, further comprising pinch valves for switching between the radioactive stock solution and the dilution stock solution.

7. The radioactive dose dispensing apparatus according to claim 1, wherein said container is formed as a plunger-operated syringe.

8. The radioactive dose dispensing apparatus according to claim 7, further comprising drive means for actuating said plunger-operated syringe.

9. The radioactive dose dispensing apparatus according to claim 8, wherein said drive means is a linear drive mechanism for actuating said plunger-operated syringe.

* * * * *